United States Patent [19]

Oswell

[11] 4,306,486

[45] Dec. 22, 1981

[54] LOW COST MULTIPLE ROUND LAUNCHER

[75] Inventor: Herman R. Oswell, Huntsville, Ala.

[73] Assignee: The United States of America as represented by the Secretary of the Army, Washington, D.C.

[21] Appl. No.: 81,303

[22] Filed: Oct. 2, 1979

[51] Int. Cl.[3] ..... F41F 3/04

[52] U.S. Cl. ..... 89/1.816; 89/1 L

[58] Field of Search ..... 89/1.816, 1.817, 1.818, 89/1.819, 1.808, 1 L

[56] References Cited

U.S. PATENT DOCUMENTS

| | | | |
|---|---|---|---|
| 2,792,962 | 5/1957 | Granfelt | 89/1.816 X |
| 3,319,522 | 5/1967 | Gould et al. | 89/1.816 X |

FOREIGN PATENT DOCUMENTS

| | | | |
|---|---|---|---|
| 1453822 | 5/1969 | Fed. Rep. of Germany | 89/1.816 |
| 2408810 | 6/1979 | France | 89/1.816 |
| 578034 | 6/1969 | United Kingdom | 89/1.816 |

*Primary Examiner*—David H. Brown

*Attorney, Agent, or Firm*—Nathan Edelberg; Robert P. Gibson; Harold W. Hilton

[57] ABSTRACT

A multiple round rocket launcher and method of fabricating the rocket launcher which includes a plurality of tubes secured together along the length thereof. Each tube is of hexagonal cross-sectional configuration and the launcher is of a honeycomb construction.

3 Claims, 4 Drawing Figures

LOW COST MULTIPLE ROUND LAUNCHER

BACKGROUND OF THE INVENTION

The desired features of an expendable, multi-round, rocket launcher pod are low cost and weight. Additionally, the pod must have maximum structural rigidity for maintainance of aim. Typically, multiple round rocket launchers have relied on box frames with tubes held in place by bulkheads. Such launchers are not only costly but result in launcher pod weights which may be 25 to 50 percent of the weight of the rockets in the pods. The present invention is directed to the use of a honeycomb type structure which can be fabricated at low cost and will result in a pod structural weight which is only 10 to 15 percent of the weight of the rockets.

SUMMARY OF THE INVENTION

A multiple round rocket launcher comprised of a honeycomb construction with each tube having a hexagonal cross-section. Metal sheets are formed into a semi-hexagonal cross-sectional configuration with a flat section between each semi-hexagonal section. A pair of formed sheets are placed together in opposing relation to form a hexagonal assembly comprised of a plurality of hexagonal tubes. The sheets are spot welded along the length of the flat section between the raised portions of the hexagonal configuration to form a single assembly comprised of a plurality of hexagonal tubes. Additional similar assemblies are provided in the same manner and each assembly is bonded to adjacent assemblies to form a launcher pod having a plurality of hexagonal launch tubes.

DESCRIPTION OF THE PREFERRED EMBODIMENT

Figure 1:
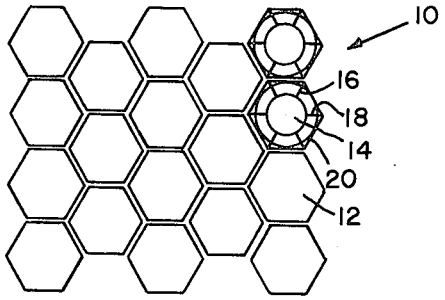
FIG. 1 is an end view of the launcher of the present invention illustrating the hexagonal configuration of the launch tubes and the honeycomb construction of the launcher.

As seen in FIG. 1, a multiple round rocket launcher 10 is comprised of a plurality of hexagonal launch tubes

12 assembled in a honeycomb construction. A rocket 14 is illustrated in a few of the launch tubes. Fins 16 of the rocket are disposed in the peaks 18 of the hexagonal tube and the round portion of the rocket engages the flats 20 of the hexagon. If the rocket is to spin within the tube, the fins must be mounted on a rotating fin barrel so that they do not rotate relative to the launch tube.

Figure 2:
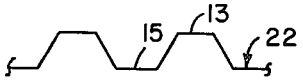
FIG. 2 is an end view of a formed metal sheet for assembly to a second metal sheet.
Figure 3:
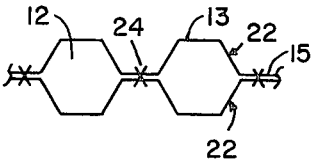
FIG. 3 is an end view of a pair of metal sheets welded together to form a first launch tube assembly comprised of a pair of tubes.
Figure 4:
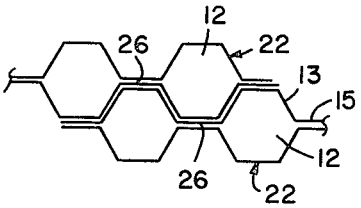
FIG. 4 is an end view illustrating a plurality of assemblies of FIG. 3 bonded together.

FIGS. 2–4 illustrate the method of fabrication of the honeycomb structure. Metal sheets 22 are first formed in the manner shown in FIG. 2 on either a sheet metal brake or by a special set of rollers. As seen in FIG. 2 a pair of semi-hexagonal raised tube sections 13 are shown formed in plate 22. A flat section 15 extends on both sides of the semi-hexagonal sections. However, as many semi-hexagonal tube sections and adjoining flat sections as desired may be formed in plate 22. Two of the sheets are postioned as shown in FIG. 3 and are welded along the flat 15 adjoining plates between raised sections forming tubes 12. The weld may be a seam or spot weld along the length of the assembly. The weld is indicated at 24. After the assembly, which may consist of any number of tubes 22, is welded, the assemblies are then positioned, in stacked relation as shown in FIG. 4. Each assembly is bonded (by epoxy glue, for example) together at adjoining surfaces, generally indicated at 26. The resulting structure will provide the necessary dimensional accuracy and structural rigidity for use as a rocket launch pod as well as a shipping container.

I claim:

1. A multiple round rocket launcher comprising:

(a) a plurality of tube assemblies, each assembly including metal sheets having semi-hexagonal sections formed thereon and a flat section between each semi-hexagonal section, said sheets being placed in opposing relation with said flat surfaces in mating contact to form tubes of hexagonal cross-sectional configuration;

(b) means for securing said sheets together along said flat surfaces;

(c) said plurality of tube assemblies being placed in a honeycomb configuration; and, (d) means for securing said assemblies together in said honeycomb assembly.

2. A multiple round rocket launcher as in claim 1 wherein said means for securing said sheets together is by welding.

3. A multiple round rocket launcher as in claim 1 wherein said means for securing said assemblies together in said honeycomb configuration is by bonding.

* * * * *